US010335625B2

(12) United States Patent
Liu et al.

(10) Patent No.: US 10,335,625 B2
(45) Date of Patent: Jul. 2, 2019

(54) PHOSPHATE FIRE-EXTINGUISHING COMPOSITION

(71) Applicant: XI'AN WESTPEACE FIRE TECHNOLOGY CO., LTD., Shaanxi (CN)

(72) Inventors: Honghong Liu, Shaanxi (CN); Wei Tian, Shaanxi (CN); Tao Ji, Shaanxi (CN)

(73) Assignee: Xi'an Westpeace Fire Technology Co., Ltd., Shaanxi (CN)

( * ) Notice: Subject to any disclaimer, the term of this patent is extended or adjusted under 35 U.S.C. 154(b) by 177 days.

(21) Appl. No.: 14/430,127

(22) PCT Filed: Sep. 18, 2013

(86) PCT No.: PCT/CN2013/083809

§ 371 (c)(1),
(2) Date: Mar. 20, 2015

(87) PCT Pub. No.: WO2014/044199

PCT Pub. Date: Mar. 27, 2014

(65) Prior Publication Data

US 2015/0246255 A1 Sep. 3, 2015

(30) Foreign Application Priority Data

Sep. 21, 2012 (CN) ..... 2012 1 0352985

(51) Int. Cl.
*A62D 1/06* (2006.01)
*A62D 1/00* (2006.01)

(52) U.S. Cl.
CPC *A62D 1/06* (2013.01); *A62D 1/00* (2013.01)

(58) Field of Classification Search
CPC ..... A62D 1/06; A62D 1/00
See application file for complete search history.

(56) References Cited

U.S. PATENT DOCUMENTS 7,070,704 B2 * 7/2006 Kang ..... A62D 1/005 169/46
9,199,108 B2 * 12/2015 Guo ..... A62D 1/06
2005/0115721 A1 6/2005 Blau et al.
2012/0295031 A1 * 11/2012 Grunlan ..... C09D 7/61 427/407.2
2013/0181157 A1 * 7/2013 Guo ..... A62D 1/06 252/2

FOREIGN PATENT DOCUMENTS

| | | | | |
|---|---|---|---|---|
| CA | 2811459 A1 | | 3/2012 | |
| CA | 2812181 | | 3/2012 | |
| CN | 101239227 A | | 8/2008 | |
| CN | 102179024 A | * | 9/2011 | ..... A62D 1/06 |
| CN | 102179026 A | * | 9/2011 | ..... A62D 1/06 |
| CN | 102614617 A | | 8/2012 | |
| CN | 102824715 A | | 12/2012 | |
| EP | 2 476 466 A1 | | 7/2012 | |
| WO | WO 00/15305 A1 | | 3/2000 | |

OTHER PUBLICATIONS

Extended European Search Report for European Application No. 13838140.5 dated May 27, 2016.

* cited by examiner

*Primary Examiner* — Peter F Godenschwager
*Assistant Examiner* — Andrew J. Oyer
(74) *Attorney, Agent, or Firm* — Muncy, Geissler, Olds & Lowe, P.C.

(57) ABSTRACT

Disclosed is a phosphate fire-extinguishing composition, the fire-extinguishing composition containing a phosphate compound, the phosphate compound being one or more of sodium hexametaphosphate, ammonium phosphate, diammonium hydrogen phosphate, trisodium phosphate, and ferric phosphate; the fire-extinguishing composition uses a pyrotechnic agent as a heat source and power source; the pyrotechnic agent is ignited to produce high temperature; the high temperature is utilized to heat and decompose the fire-extinguishing composition to generate a number of fire-extinguishable substances, these substances are sprayed out together with the pyrotechnic agent to extinguish the fire. The fire-extinguishing composition of the present invention has simple components, stable and excellent performance, can be easily stored for an extended period of time, and is non-toxic and environmentally friendly.

7 Claims, No Drawings

PHOSPHATE FIRE-EXTINGUISHING COMPOSITION

This application is a national stage under 35 U.S.C. 371 of International Application No.: PCT/CN2013/083809, which was filed on Sep. 18, 2013, and which claims priority to Chinese Application No,: 201210352985.5, which was filed in China on Sep. 21, 2012, and which are both herein incorporated by reference.

TECHNICAL FIELD

The present invention belongs to the field of aerosol fire extinguishing techniques, specifically relates to a phosphate fire extinguishing composition.

BACKGROUND ART

Concerning the protection of the ozone layer, and phasing out the ozone-depleting substances, the notable Vienna Convention and the Montreal Protocol were signed successively by the main states around the world during 1985-1987. Under this background, the Halon fire extinguishing agents, which were disruptive to the ozone layer, were prohibited in the developed countries in Europe and America, and categorized as substances to be phased out in other countries. In 1992, the China's National Scheme On Phasing Out Ozone Depleting Substances were formulated in China. In the fire protection industry of China, the mission of phasing out Halon 1211 was achieved on Dec. 31, 2005; the production of Halon 1301 was entirely terminated from Jan. 1, 2006; the use of Halon was entirely terminated by the end of 2010. Therefore, in various countries, it has become one of the hot research issues to seek for substitute products for Halon fire extinguishing agents and substitute techniques, which are non-disruptive to the ozone layer of the atmosphere, highly efficient in extinguishing fire, nontoxic and harmless. Currently three categories of substitute products for Halons are widely being developed: haloalkanes, inert gases and aerosol fire extinguishing agents. The aerosol fire extinguishing agent is an extremely highly efficient novel fire extinguishing agent, which has an ozone depletion potential (ODP) of zero. It is nontoxic, harmless, and residual free; it has low price, and the investment demand for its manufacturing equipment is low. Under the urgent background of phasing out Halon, the aerosol fire extinguishing technique is intensively supported by the government, while it also fits the market demand; therefore it becomes one of the remarkable substitute techniques for Halons in the past ten-odd years.

The aerosol fire extinguishing agents, which are mainly divided into two types, S-type and K-type, are composed of oxidants, reductants, burning rate controllers and adhesives. The main fire extinguishing mechanisms of the aerosol fire extinguishing agents are: 1, heat absorption and cooling; 2, chemical inhibition; 3, suffocation; 4, insulation; wherein chemical inhibition is the main mechanism. Though the aerosol fire extinguishing agents are significantly advantageous in aspects like extinguishing efficiency, storage status, construction cost, maintenance, toxicity, secondary damage, environmental friendliness, extinguishing concentration, etc., there are shortcomings in their application, due to the large-scale emission of gas, active particles in the redox reaction, and the simultaneous heat release. In order to effectively decrease the temperature of the device and aerosol, and to prevent the secondary fire, adding a cooling system to the fire extinguishing device is required. Simple physical cooling leads to complicated and bulky structure of the device, complicated process flow and high cost; and due to the presence of the cooling system, large amount of active particles are inactivated, result in greatly degraded extinguishing performance. In addition, affected by the cooling performance, the nozzle temperature of the current aerosol fire extinguishing products is usually too high, which readily harms the operators.

SUMMARY OF INVENTION

To resolve the inherent defects of the fire extinguishing agent in the prior art, the present invention provides a phosphate fire extinguishing composition, which has high extinguishing efficacy, excellent safety performance, and high utilization ratio.

The solution to the problem in the present invention is:

A phosphate fire extinguishing composition, characterized in that, the fire extinguishing composition contains a phosphate compound, the phosphate compound is one or more of sodium hexametaphosphate, ammonium phosphate, diammonium hydrogen phosphate, trisodium phosphate, ferric phosphate.

A pyrotechnic agent is used as the heat source and the power source of the fire extinguishing composition. By igniting the pyrotechnic agent, the composition is heated by the high temperature generated from the combustion of the pyrotechnic agent, and it is subjected to a decomposition reaction. A large amount of fire extinguishable substances are produced, and ejected out together with the pyrotechnic agents; thereby the target of fire extinguishing is achieved.

The fire extinguishing composition further contains an additive in the amount of more than 0% to 10% or less by mass percentage.

The additive is one or more of polyvinyl alcohol, hydroxypropyl methyl cellulose, acetal adhesives, shellac, starch, dextrin, epoxy resin, graphite powder, talcum powder, stearate.

The fire extinguishing composition further contains a flame-retardant component in the amount of more than 0% to 60% or less by mass percentage.

The flame-retardant component is one or more of inorganic flame retardants, halogen-based flame retardant, phosphorus-based flame retardants or nitrogen-based flame retardant.

Further, the components and their contents in the fire extinguishing composition are preferably:

| | |
|---|---|
| Phosphate compound | 30%~95% |
| Flame-retardant extinguishing component | 5%~60% |
| Additive | 1%~10% |

Further, the components and their contents in the fire extinguishing composition are preferably:

| | |
|---|---|
| Phosphate compounds | 60%~90% |
| Flame-retardant extinguishing components | 5%~30% |
| Additives | 1%~5% |

Further, the components and their contents in the fire extinguishing composition are preferably:

| | |
|---|---|
| Phosphate compounds | 80%~90% |
| Flame-retardant extinguishing components | 5%~15% |
| Additives | 1%~5% |

The fire extinguishing composition of the present invention can be molded into spheres, sheets, stripes, blocks and honeycombs by processes such as pelleting, molding, extrusion, and may be subjected to a surface coating treatment. Hydroxypropyl methylcellulose is preferably added during the surface coating treatment. This surface coating agent can improve the surface smoothness of the composition system, enhance its strength and resistance to abrasion and vibration, thereby preventing the composition system from chalking, slagging and spilling out from the extinguisher during transport. To facilitate the molding process, graphite, talcum powder, stearate and the like can be appropriately added.

The pyrotechnic agent is used as the heat source and the power source of the fire extinguishing composition in the present invention. By igniting the pyrotechnic agent, the fire extinguishing composition heated by the high temperature generated from the combustion of the pyrotechnic agent is subjected to a decomposition reaction, which produces a large amount of fire extinguishable substances. The fire extinguishable substances, together with the pyrotechnic agents, are ejected out from the nozzle of the fire extinguishing device; thereby the target of fire extinguishing is achieved.

Comparing with the prior art, the advantages of the present invention are as follow:

1) In the circumstance of being heated at high temperature, the phosphate fire extinguishing composition of the present invention can rapidly undergo endothermic decomposition. The heat absorption in the decomposition can effectively and rapidly reduce the heat released by the combustion of the pyrotechnic agent, and greatly decrease the temperature of the extinguisher nozzle and the ejected substances; the complicated cooling system of the fire extinguishing device is omitted, while the risk of secondary fire is eliminated. A large amount of effective fire extinguishable substances, mainly liquid or solid particles, are released at the instant that the composition is heated; through the synergistic effect of various particles, the extinguishing time is greatly shortened.
2) A flame retardant can be added into the phosphate fire extinguishing composition of the present invention. Through the flame-retardant effect of the decomposition products of the flame retardant, the possibility of combustion source rekindling is reduced, while the extinguishing performance of the fire extinguishing agent is further enhanced.
3) The phosphate fire extinguishing composition of the present invention can be easily processed and molded, and it can be used alone or be used in combination with a physical coolant.
4) The phosphate fire extinguishing composition of the present invention is stable in performance, easy for long-term storage, non-toxic, and has excellent environmental friendly properties.

DESCRIPTION OF THE EMBODIMENTS

The fire extinguishing composition of the present invention is further described through the detailed examples below.

The fire extinguishing composition indicated above is added into a K-type thermal aerosol fire extinguishing device, meanwhile the commercially distributed S-type aerosol fire extinguishing agent or K-type aerosol fire extinguishing agent is added into the same fire extinguishing device. In detail:

EXAMPLE 1

A 50 g sample of composition prepared with sodium hexametaphosphate, tetrachlorobisphenol A, cyanurotriamide, acetal adhesive and magnisium stearate is added into a fire extinguishing device which contains 50 g of K-type thermal aerosol generating agent. A test of extinguishing 93# petrol fire in an oil tray with area of 0.25 $m^2$ is performed. The test result is shown in Table 1.

EXAMPLE 2

A 50 g sample of composition prepared with ammonium phosphate, diammonium hydrogen phosphate, potassium chloride, hydroxypropyl methyl cellulose and talcum powder is added into a fire extinguishing device which contains 50 g of K-type thermal aerosol generating agent. A test of extinguishing 93# petrol fire in an oil tray with area of 0.25 $m^2$ is performed. The test result is shown in Table 1.

EXAMPLE 3

A 50 g sample of composition prepared with diammonium hydrogen phosphate, potassium chloride, cyanurotriamide and magnisium stearate is added into a fire extinguishing device which contains 50 g of K-type thermal aerosol generating agent. A test of extinguishing 93# petrol fire in an oil tray with area of 0.25 $m^2$ is performed. The test result is shown in Table 1.

EXAMPLE 4

A 50 g sample of composition prepared with ferric phosphate, tetrachlorobisphenol A, hydroxypropyl methyl cellulose and talcum powder is added into a fire extinguishing device which contains 50 g of K-type thermal aerosol generating agent. A test of extinguishing 93# petrol fire in an oil tray with area of 0.25 $m^2$ is performed. The test result is shown in Table 1.

EXAMPLE 5

A 50 g sample of composition prepared with trisodium phosphate, potassium chloride and hydroxypropyl methyl cellulose is added into a fire extinguishing device which contains 50 g of K-type thermal aerosol generating agent. A test of extinguishing 93# petrol fire in an oil tray with area of 0.25 $m^2$ is performed. The test result is shown in Table 1.

EXAMPLE 6

A 50 g sample of composition prepared with ammonium phosphate and ferric phosphate is added into a fire extinguishing device which contains 50 g of K-type thermal aerosol generating agent. A test of extinguishing 93# petrol fire in an oil tray with area of 0.25 $m^2$ is performed. The test result is shown in Table 1.

COMPARATIVE EXAMPLE 1

A sample of fire extinguishing device which only contains 50 g of K-type aerosol fire extinguishing agent is taken. A test of extinguishing 93# petrol fire in an oil tray with area of 0.25 $m^2$ is performed. The test result is shown in Table 1.

COMPARATIVE EXAMPLE 2

A sample of fire extinguishing device which only contains 50 g of S-type aerosol fire extinguishing agent is taken. A test of extinguishing 93# petrol fire in an oil tray with area of 0.25 $m^2$ is performed. The test result is shown in Table 1.

COMPARATIVE EXAMPLE 3

A 50 g sample of composition prepared with tetrachlorobisphenol A, cyanurotriamide, acetal adhesive and magnisium stearate is added into a fire extinguishing device which contains 50 g of K-type thermal aerosol generating agent. A test of extinguishing 93# petrol fire in an oil tray with area of 0.25 $m^2$ is performed. The test result is shown in Table 1.

After molding with the conventional preparation process, 50 g of the ferric phosphate fire extinguishing composition of the present invention is separately added into a fire extinguishing device which contains 50 g of K-type thermal aerosol generating agent. The 8B fire, F type fire and 3 $m^3$ all-immersion extinguishing tests are performed.

The 8B fire extinguishing test: see the regulation in section 6.3.2.1, GA86-2009 for the detailed test model. In the crossover test, three shots are applied in each group.

F type fire test is performed according to the following model: a cast iron frying pan with diameter of 320 mm and height of 90 mm is taken. Then 25 mm edible pure canola oil is added into the pan, and heated to spontaneous combustion by electric furnace. Continue the heating for 1 min since the spontaneous combustion of the oil (the rate of heating is more than 6° C. per minute), then the extinguishing process is performed. The power supply is switched off after emptying the extinguisher. The fire extinguishing is considered as successful if rekindling is not observed 10 min after the flame extinction. Three shots are applied in each group in the crossover test.

The model of 3 $m^3$ all-immersion fire extinguishing test is as follows. The fuel tanks are divided into 4 layers. In the test chamber there are two fuel tanks located at rear left and front right on the top layer, two fuel tanks located at front left and rear right on the second layer, three fuel tanks located at the midpoint of the three lateral platforms on the third layer, four fuel tanks located at the four corners and the back of baffle on the fourth layer; totally there are 12 fuel tanks And n-heptane is added into each of the fuel tanks to a height of 50 mm. The size of the fuel tank is Φ82×100. The n-heptane is ignited, allowed to pre-burn for 30 s, then the door is closed, the extinguisher is started. The door of the test chamber is opened 30 s after emptying the extinguisher. The temperature of the test chamber body is kept not lower than 20° C. The temperature of the chamber body is measured with a detector and recorded after each test. The crossover, circulated comparison of the current products is performed in the tests.

In the comparative examples, 50 g of conventional K-type aerosol fire extinguishing agent or S-type aerosol fire extinguishing agent, and the coolant, are added into the fire extinguishing device. The fire extinguishing test is performed in the same condition. The results are shown in Table 1.

TABLE 1

Comparison of components and contrast of test results

| | Content (mass percent) of components in Examples | | | | | | Comparative Examples | | |
|---|---|---|---|---|---|---|---|---|---|
| Components | 1 | 2 | 3 | 4 | 5 | 6 | 1 | 2 | 3 |
| K-type fire extinguishing agent | | | | | | | • | | |
| S-type fire extinguishing agent | | | | | | | | • | |
| Sodium hexametaphosphate | 50 | | | | | | | | |
| Ammonium phosphate | | 54 | | | | 50 | | | |
| Diammonium hydrogen phosphate | | 10 | 75 | | | | | | |
| Trisodium phosphate | | | | | 90 | | | | |
| Ferric phosphate | | | | 81 | | 50 | | | |
| Potassium chloride | | 30 | | | 8 | | | | |
| Tetrachlorobisphenol A | 20 | | 3.5 | 15 | | | | | 56 |
| Cyanurotriamide | 20 | | 20 | | | | | | |
| Hydroxypropyl methyl cellulose | | 3 | | 3 | 2 | | | | 38 |
| Acetal adhesive | 6 | | | | | | | | 3.5 |
| Magnisium stearate | 4 | | 1.5 | | | | | | 2.5 |
| Talcum powder | | 3 | | 1 | | | | | |
| | Test result | | | | | | | | |
| *8B | A | A | A | A | A | A | N | N | N |
| F | A | A | A | A | A | A | N | N | N |
| 3 $m^3$ | 27 | 33 | 28 | 29 | 32 | 33 | 25 | 13 | 9 |

*Notes:
A denotes that fire is extinguished in all the three shots.
N denotes that fire is extinguished in none of the three shots.
The numbers in the cells denote the total count of the successfully extinguished fire.

The S, K-type fire extinguishing agents used in the Comparative Examples 1 to 3 in the table above are commercially available. From Table 1 it can be observed that all the phosphate fire extinguishing compositions of the present invention in Examples 1 to 6 can extinguish the fire in the oil tray test, therefore they are far more superior to the condition of Comparative Examples 1 to 3 in extinguishing efficiency. Besides, open flame at the nozzle presents in none of the Examples 1 to 6.

The above specific examples are merely exemplary, and various modifications and variations made by persons skilled in the art on the basis of the teaching by the examples of the present invention fall within the protection scope of the present invention. Those skilled in the art should understand that the above specific description is only for the purpose of explaining the present invention and are not intended to limit the present invention in its scope.

The invention claimed is:

1. A phosphate fire extinguishing composition, wherein the fire extinguishing composition contains a phosphate compound, a flame-retardant extinguishing component, which enhances a fire extinguishing effect of the fire extinguishing composition and an additive, and the components and their contents in the fire extinguishing composition include:

phosphate compound 30%~95%, flame-retardant extinguishing component 5%~60%, and additive 1%~10%, the phosphate compound is ferric phosphate; and the phosphate fire extinguishing composition is spheres, sheets, strips, blocks or honeycombs.

2. The phosphate fire extinguishing composition according to claim 1, wherein the additive is one or more of polyvinyl alcohol, hydroxypropyl methyl cellulose, acetal adhesives, shellac, starch, dextrin, epoxy resin, graphite powder, talcum powder, stearate.

3. The phosphate fire extinguishing composition according to claim 1, wherein the flame-retardant extinguishing component is one or more of inorganic flame retardants, halogen-based flame retardant, phosphorus-based flame retardants or nitrogen-based flame retardants.

4. The phosphate fire extinguishing composition according to claim 1, wherein the components and their contents in the fire extinguishing composition are as follows:

phosphate compound 60%~90%, flame-retardant extinguishing component 5%~30%, and additive 1%~5%.

5. The phosphate fire extinguishing composition according to claim 4, wherein the components and their contents in the fire extinguishing composition are as follows:

phosphate compound 80%~90%, flame-retardant extinguishing component 5%~15%, and additive 1%~5%.

6. A phosphate fire extinguishing composition comprising:

a phosphate compound present in the range between 30%-95% of the fire extinguishing composition;

a flame-retardant extinguishing component present in the range between 5%-60% of the fire extinguishing composition; and an additive present in the range between 1%-10% of the fire extinguishing composition, wherein the phosphate compound is ferric phosphate or combination of sodium hexametaphosphate and ferric phosphate, and wherein the phosphate fire extinguishing composition is molded into spheres, sheets, strips, blocks or honeycombs.

7. The phosphate fire extinguishing composition according to claim 6, wherein the fire extinguishing composition further comprises a second additive present in the range between 0% to 10% of the fire extinguishing composition, wherein the second additive is selected from the group comprising of polyvinyl alcohol, hydroxypropyl methyl cellulose, acetal adhesives, shellac, starch, dextrin, epoxy resin, graphite powder, talcum powder, or stearate.

* * * * *